US005499515A

United States Patent [19]

Kawamura et al.

[11] Patent Number: 5,499,515

[45] Date of Patent: Mar. 19, 1996

[54] ROTARY VANE-TYPE COMPRESSOR

[75] Inventors: Chuichi Kawamura; Ichiro Kasugai; Mitsuru Hashimoto; Masahiro Ida, all of Kariya, Japan

[73] Assignee: Kabushiki Kaisha Toyoda Jidoshokki Seisakusho, Kariya, Japan

[21] Appl. No.: 263,032

[22] Filed: Jun. 21, 1994

[30] Foreign Application Priority Data

Jun. 23, 1993 [JP] Japan ..... 5-152487

[51] Int. Cl.[6] ..... F04C 18/344; F04C 29/02

[52] U.S. Cl. ..... 62/470; 418/93; 418/DIG. 1

[58] Field of Search ..... 62/469, 470; 418/DIG. 1, 418/93, 268

[56] References Cited

U.S. PATENT DOCUMENTS

| | | | |
|---|---|---|---|
| 2,455,297 | 11/1948 | Curtis et al. | 418/DIG. 1 |
| 3,743,453 | 7/1973 | Abendschein et al. | 418/93 X |
| 3,852,003 | 12/1974 | Adelbert et al. | 418/DIG. 1 |
| 4,279,578 | 7/1981 | Kim et al. | 418/DIG. 1 |
| 4,441,871 | 4/1984 | Boller | 418/DIG. 1 |
| 4,553,906 | 11/1985 | Boller et al. | 418/DIG. 1 |
| 4,810,177 | 3/1989 | Shibuya et al. | 418/268 X |

*Primary Examiner*—William E. Tapolcai

*Attorney, Agent, or Firm*—Brooks Haidt Haffner & Delahunty

[57] ABSTRACT

A vane-type rotary refrigerant compressor adapted for use in an air conditioning system is disclosed which includes a rotor fixed on a drive shaft for rotation therewith and disposed in an elliptical chamber of a cylinder block which is enclosed by a housing and whose axial ends are closed by front and rear side plates. The rotor has a plurality of slots in which vanes are slidably received so that a plurality of compression chambers are formed during the operation of the compressor. An oil separator compartment is defined by the housing and the rear side plate, communicating with a discharge chamber into which compressed refrigerant is discharged. In the rear side plate is formed a discharge passage establishing communication between the discharge chamber and the oil separator compartment. The discharge passage has a restricted portion and a bend so as to provide resistance against the flow of the compressed refrigerant for damping its pulsating stream.

15 Claims, 3 Drawing Sheets

ROTARY VANE-TYPE COMPRESSOR

BACKGROUND OF THE INVENTION

The present invention relates to a rotary vane-type refrigerant compressor which is adapted for use in an air refrigeration system. More specifically, it relates to an arrangement in the rotary compressor for damping a pulsating flow of refrigerant gas occurring during the operation of the compressor.

There is known a typical rotary compressor of the above type which has a rotor carried by a drive shaft and disposed in an elliptical chamber of a cylinder block which is enclosed by a housing and whose axial ends are closed by front and rear side plates. The rotor has a plurality of approximately radial slots in which their associated vanes are slidably received such that their outer ends are brought in fluid-tight contact with the inner elliptical surface of the rotor chamber of the cylinder block under the influence of centrifugal force developed by rotation of the rotor and such that a plurality of compression chambers are formed, each defined by two adjacent vanes, the outer peripheral surface of the rotor, the inner elliptical surface of the cylinder block and the inner surfaces of the front and rear side plates. As the rotor is rotated in the rotor chamber, the volume of each compression chamber is increased and decreased alternately so as to draw a refrigerant gas into the compression chamber and then compress and discharge the gas into a discharge chamber which is formed between the cylinder block and the housing.

Between the rear side plate and the rear portion of the housing is formed a compartment accommodating therein an oil separator which is in communication with the discharge chamber through a compressed gas passage and having at its bottom an oil reservoir where lubricating oil contained in the refrigerant gas and separated therefrom by the oil separator is received. Therefore, the space in the oil separator compartment above the level of the reservoir of oil is filled with refrigerant gas under a discharge pressure. In operation of the compressor, the lubricating oil reserved in the reservoir at the bottom of the oil separator compartment is subjected to the relatively high pressure of the refrigerant gas in the space thereabove, which forces part of the oil to flow through an oil passage formed in the rear side plate for feeding to various parts of the compressor which need be lubricated, such as bearings supporting the drive shaft, sliding surfaces between the rotor and the front and rear side plates, and the vane slots in which the vanes slide.

Since discharging of refrigerant gas from the respective compression chambers into the discharge chamber takes place intermittently, the gas pressure in the discharge chamber is varied accordingly, thereby causing a pulsating stream of gas which, if discharged from the compressor without being damped, causes harmful vibration and hence noise development in component parts of the air conditioning system in which the compressor is incorporated. The upper space in the oil separator compartment where the compressed refrigerant gas prevails can serve to allow the compressed refrigerant of the pulsating stream to be expanded therein, thus damping or diminishing the pulsation of the refrigerant.

During operation of the compressor at a low speed, however, the flow of the compressed refrigerant gas passing from the discharge chamber into the oil separator compartment is reduced, so that more lubricating oil tends to be separated from the refrigerant and, therefore, the level of the lubricating oil in the reservoir is raised and hence the pulsation-damping space above the oil level is reduced. Consequently, the effect of the space to damp the pulsation is weakened, with the result that vibration and noise development may be increased during operation of the compressor at a low speed.

SUMMARY OF THE INVENTION

It is an object of the present invention, therefore, to provide a rotary compressor of the vane-type which can reduce vibration and noise development due to pulsation, without making the compressor larger in size.

According to the invention, there is provided a rotary compressor having a rotor rotatable in a cylinder block enclosed by housing means and having both ends thereof closed by a pair of front and rear side plates, a plurality of vanes slidably received in slots formed extending approximately radially in the rotor and cooperating with the cylinder block, the rotor and the front and rear side plate to form a plurality of compression chambers, a discharge chamber for receiving therein refrigerant gas compressed in the compression chamber and discharged therefrom, an oil separator compartment formed in the rear portion of the compressor by the housing means and the rear side plate. The oil separator compartment has incorporated therein an oil separator which is fixed to the rear side plate in contact therewith for separating part of the lubricating oil contained in the refrigerant. The compartment has formed at its top a delivery port through which the compressed refrigerant is discharged from the compressor, and at the bottom thereof is formed an oil reservoir. The discharge chamber and the oil separator compartment are in communication with each other through discharge passage means part of which is disposed in the area of contact between the rear side plate and the oil separator, and which has a restricted passage portion and at least one bend for providing resistance against the flow of the compressed refrigerant and also for allowing the refrigerant to expand when it comes out of the discharge passage means into the oil separator compartment.

Because the discharge passage means is thus arranged so as to diminish the pulsating flow of the discharged refrigerant, harmful vibration and hence noise development in the compressor, as well as in the components of the air conditioning system in which the compressor is incorporated, can be reduced even during compressor operation at a low speed when the oil level in the reservoir is raised and the pulsation damping effect of the refrigerant-filled space in the oil separator compartment is decreased.

According to the invention, the restriction of the discharge passage means may be provided by a hole formed axially through the rear side plate and having a transverse cross sectional area that is smaller than that of the delivery port, and the above referred to bend may be formed by a grooved passage portion formed in a lateral surface of the rear side plate remote from the discharge chamber.

The above and other objects and features of the present invention will be apparent from the following detailed description of the preferred embodiment thereof in conjunction with the accompanying drawings.

DETAILED DESCRIPTION OF THE EMBODIMENTS

The following will describe a preferred embodiment of the rotary compressor according to the present invention while having reference to FIGS. 1 through 4.

Figure 1:
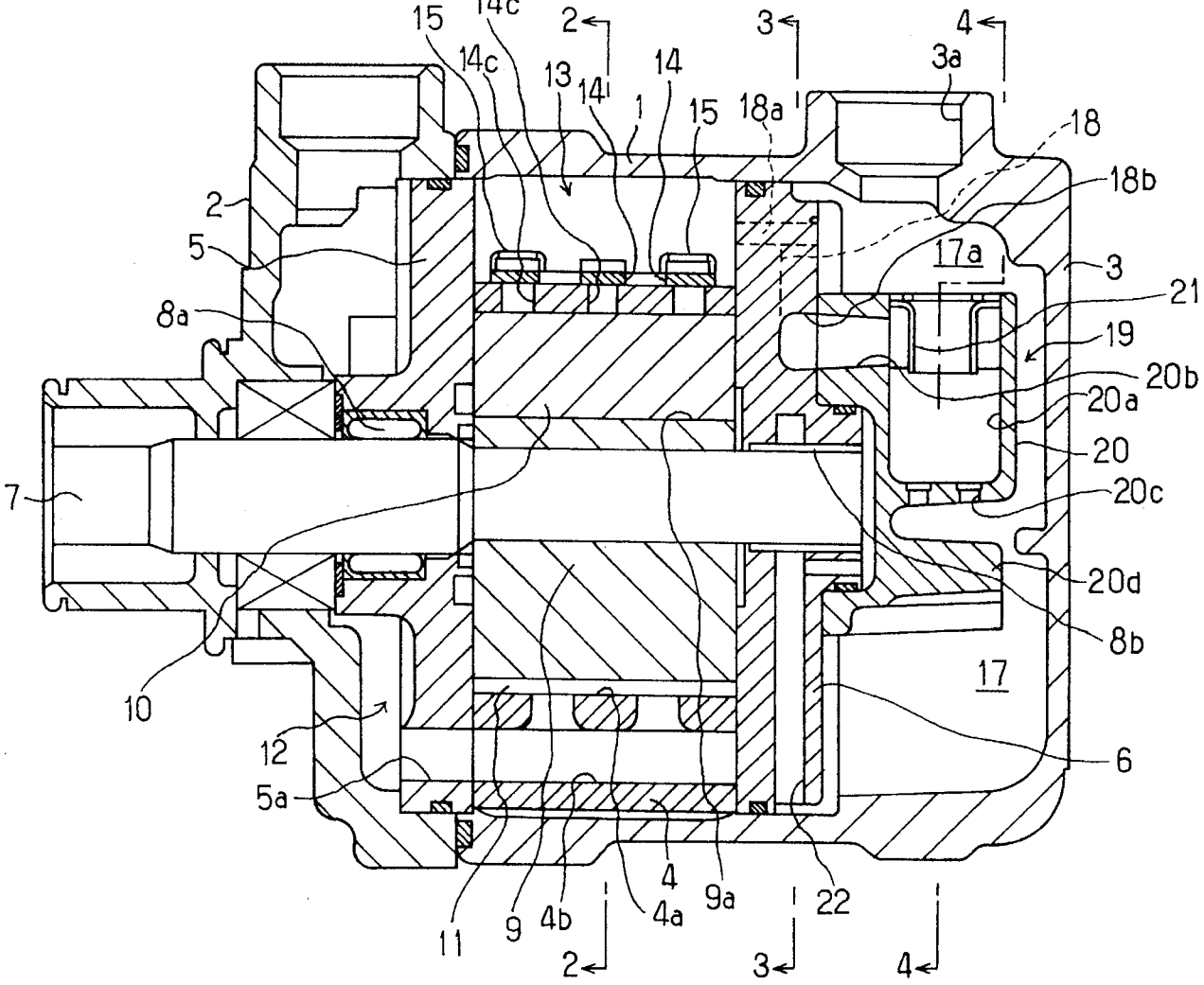
FIG. 1 is an elevational view in longitudinal cross section of a preferred embodiment of a rotary refrigerant compressor of vane type according to the present invention.
Figure 2:
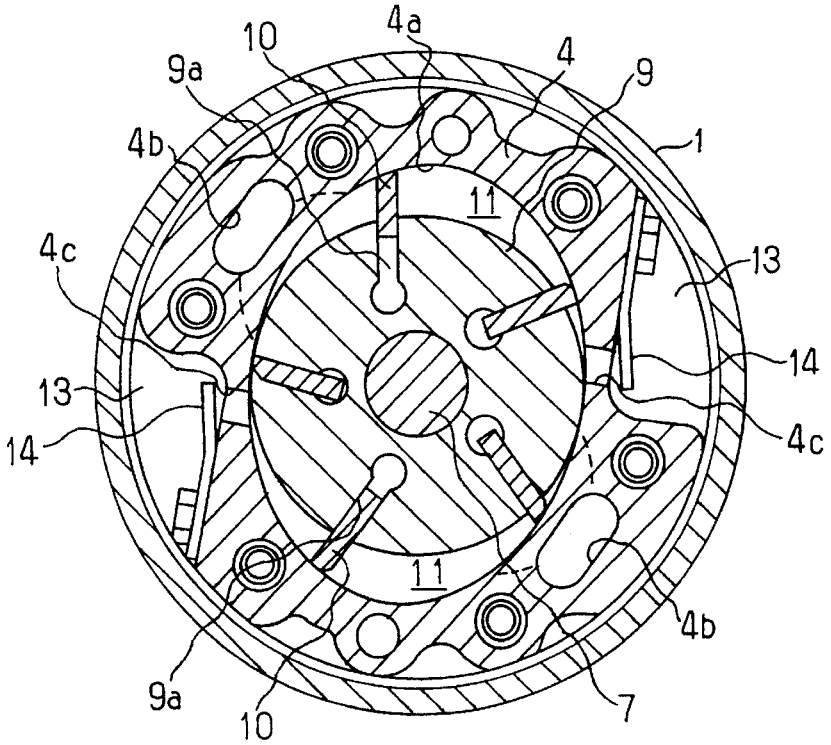
FIG. 2 is a transverse cross-sectional view taken along a rotor of the compressor.

Referring firstly to FIGS. 1 and 2, the compressor includes a cylinder block 4 of a tubular shape whose opposite axial ends are closed by a front side plate 5 and a rear side plate 6, respectively. The cylinder block 4 cooperates with the front and rear side plates 5, 6 to define a rotor chamber having an oval or elliptical shape in transverse cross section as shown clearly in FIG. 2. These three members 4, 5, 6 are enclosed by a front housing 2 and a rear housing 3. The front and rear housings 2, 3 and the front and rear side plates 5, 6 are fastened together fluid-tightly to form an integral assembly. A rotatable drive shaft 7, which is driven by an engine (not shown) of a vehicle, is supported by the front and rear side plates 5, 6 by way of radial bearings 8*a*, 8*b*, and carries thereon a rotor 9 which is rotatable therewith and disposed within the elliptical rotor chamber in the cylinder block 4.

As seen in FIG. 2, the rotor 9 is of a circular shape in transverse cross section such that the periphery of the rotor is almost in contact with the inner elliptical surface 4*a* at two opposite points on the minor axis of the ellipse of the rotor chamber, thus two spaces of a crescent shape in transverse cross section being formed between the outer surface of the rotor 9 and the inner surface 4*a* of the cylinder block 3. The rotor 9 has a plurality of approximately radial vane slots 9*a*, or five slots in the preferred embodiment, which receive therein their associated vanes 10. The vanes 10 are slidable in the slots 9*a* such that their outer ends are alternately brought out of the slots and retracted back into the slots while maintaining fluid-tight contact with the inner elliptical surface 4*a* of the cylinder block 4 under the influence of centrifugal force developed as the rotor 9 is rotated by the drive shaft 7. Variable-volume space at the inner end portion of each vane slot 9*a* is filled with oil, as will be explained hereinafter, so that the oil in the space function to push the corresponding vane 10 outward of within the slot by the centrifugal force.

Each of the above crescent shaped spaces is divided by the vanes 10 into a plurality of working or compression chambers 11, each defined by two adjacent vanes 11, the outer peripheral surface of the rotor 9, the inner elliptical surface 4*a* of the cylinder block 4, and the inner surfaces of the front and rear side plates 5, 6. As the rotor 9 is driven to rotate by the drive shaft 7, the volume of each compression chamber 11 is varied, or alternately increased and decreased progressively in a well known manner. That is, the compression chamber 11 undergoes a suction stroke when its volume is increased and a compression stroke when the volume is reduced.

A suction chamber 12 is defined between the front housing 2 and the front side plate 5, communicating with suction gas passages 5*a*, 4*b* formed in the front side plate 5 and the cylinder block 4, respectively. As shown in FIGS. 1 and 2, two discharge chambers 13 are formed by the cylinder block 4, the rear housing 3 and the front and rear side plates 5, 6, and these discharge chambers 13 are communicable with a compression chamber 11, which is then in discharging stroke, through a plurality of discharge ports 4*c* formed in the cylinder block 4 and each having a discharge reed valve 14 which is adapted to open its corresponding discharge port 4*c* for allowing compressed refrigerant gas into the discharge chamber 13. Each discharge valve 14 has a retainer 15 for regulating the lift of the valve.

As shown in FIG. 1, the rear housing 3 cooperates with the rear side plate 6 to form therebetween an oil separator compartment 17 which communicates with the discharge chambers 13 through discharge passages 18 formed in the rear side plate 6 and has located therein an oil separator 19 for separating by centrifugal force lubricating oil from the refrigerant gas discharged out of the discharge passages 18. The bottom portion of the oil separator compartment 17 provides an oil reservoir for reserving the lubricating oil separated from the refrigerant by the oil separator 19. At the top of the compartment 17 is formed a delivery port 3*a* through which the compressed refrigerant is delivered out of the compressor to be fed to an external air conditioning circuit (not shown). Reference symbol 17*a* designates a refrigerant-filled space in the oil separator compartment 17 above the oil level at the reservoir.

Figure 3:
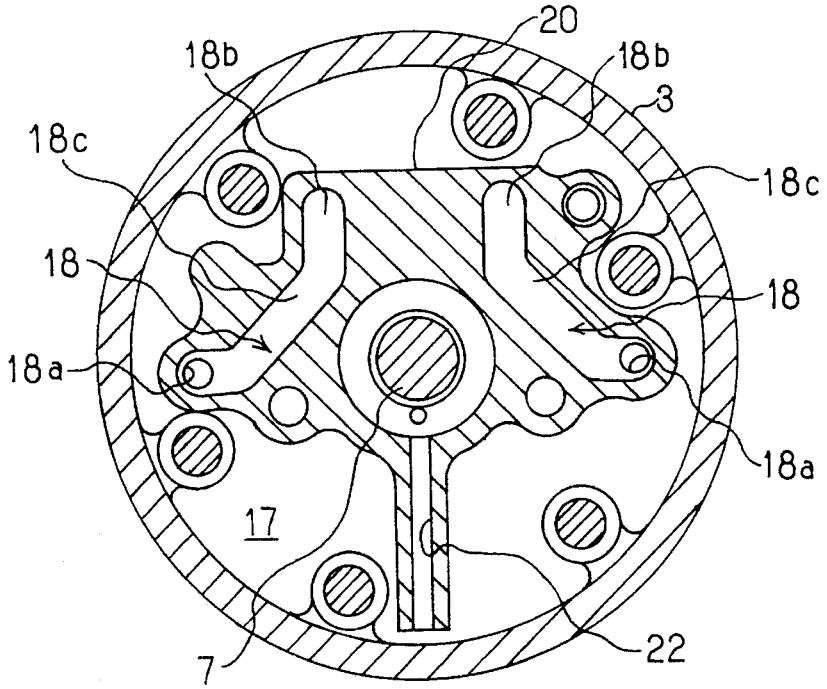
FIG. 3 is a transverse cross-sectional view taken along through the rear side plate of the compressor as seen from lines 3—3 in FIG. 1.

As shown in FIG. 3, each discharge passage 18 includes a restricted portion, or a hole 18*a* formed axially through the rear side plate 6 to open to the discharge chamber 13 with a diameter which is smaller than that of the delivery port 3*a*, a grooved passage 18*c* formed in the lateral side of the rear side plate 6 remote from the discharge chamber 13, and an outlet port 18*b* provided at the end of the grooved passage 18*c* opposite to the hole 18*a*. As seen clearly from FIG. 3, the grooved passage 18*c* is not straight, but formed with bends at two points which provide resistance against the flow of compressed refrigerant passing therethrough for assisting in diminishing the pulsating stream.

Figure 4:
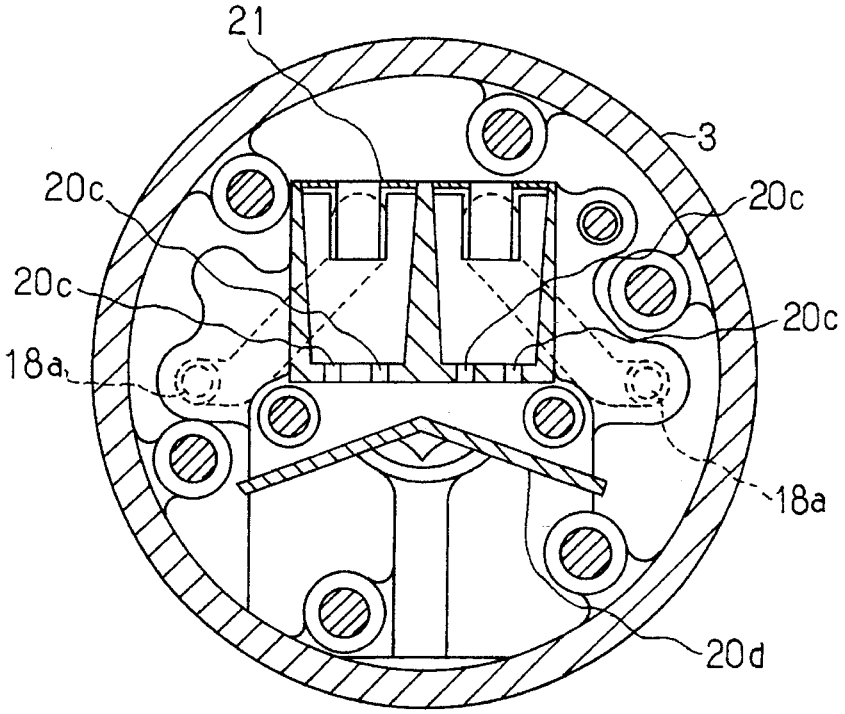
FIG. 4 is a transverse cross-sectional view taken along through the oil separator of the compressor as seen from lines 3—3 in FIG. 1.

Referring to FIGS. 1 and 4, the oil separator 19 is fixed to the rear side plate 6 such that the rear end of the drive shaft 7 and the discharge passages 18 are covered by the separator. The oil separator 19 includes two oil separator shells 20, each defining therein an oil separating chamber 20*a* and having a tubular member 21 one end of which is fixed to the top of the shell and the other end of which is opened to the oil separating chamber 20*a*. A refrigerant gas passage 20*b* is formed in the shell 20, communicating with the outlet port 18*b* of the discharge passage 18 and directed toward the outer periphery of the tubular member 21 in the oil separating chamber 20*a* so that refrigerant gas containing therein lubricating oil and coming out of the discharge passage 18 flows circling around the tubular member 21 and the oil having a higher specific gravity than the refrigerant gas is separated from the refrigerant in the oil separating chamber 20*a*. Through the bottom of the shell are bored a plurality of oil guide passages 20*c* for allowing the separated oil to drop therethrough. The oil separators 19 also include a gable-roof shaped plate 20*d* for guiding the dropped oil downward, as well as for shielding the oil level from the influence of the compressed refrigerant in the space 17*a* so that part of the oil in the reservoir may not be mixed with the refrigerant. Thus, the plate 20*d* performs the function of stabilizing the level of the oil accumulated at the oil reservoir.

In the rear side plate 6 is formed an oil feed groove 22 for guiding the lubricating oil from the oil reservoir to the bearings 8 the vane slots 9*a* and other parts of the compressor which need be oiled for lubrication.

The following will explain the operation of the rotary vane-type compressor which is constructed as described hitherto.

As the drive shaft 7 is driven by an engine of a vehicle (not shown), the rotor 9 fixed on the drive shaft is rotated and the refrigerant gas in the suction chamber 12 is drawn through the suction passages 5*a*, 4*b* into the compression chamber 11 which is then in suction stroke. The refrigerant gas is then compressed by reduction in the volume of the compression chamber 11 as the rotor 9 continues to rotate, and the compressed refrigerant is discharged into the discharge chambers 13 through the discharge ports 4*c*. Because the discharged refrigerant flows through the discharge passage 18 having the restricted and bent passage portions 18*a*, 18*c* providing resistance against the flow and then undergoes expansion when it comes out of the discharge passage into the oil separator 19, the pulsation of the refrigerant gas is damped sufficiently while it flows from the discharge chamber 13 to the oil separator chamber 19, so that the development of harmful vibration and noise due to pulsation can be suppressed over the entire range of operating speeds of the compressor.

The refrigerant gas flowing out of the discharge passage 18 through its outlet port 18*b* impinges against the outer periphery of the tubular member 21 and circles therearound. At this time, the oil contained in the refrigerant is separated therefrom by the action of centrifugal force and flows downward through the oil guide passages 20*c* and then along the guide plate 20*d* to be accumulated at the oil reservoir. On the other hand, the refrigerant gas in the oil separating chamber 20*a* flows through the tubular member 21 upward into the space 17*a*, from where it is discharged from the compressor through the delivery port 3*a*.

As it is apparent from the foregoing, even during low speed operation of the compressor, when the volume of the space 17*a* is reduced by more oil separated and reserved in the reservoir than at higher speed operation of the compressor, as described an earlier part hereof, the pulsation can be suppressed by the provision of the discharge passage 18. Additionally, because the passage 18 is formed in the rear side plate 6, pulsation damping can be accomplished without making the compressor complicated in construction and larger in size. It is also noted that forming the discharge passage 18 longer can further improve its effect of reducing the pulsation.

Figure 5:
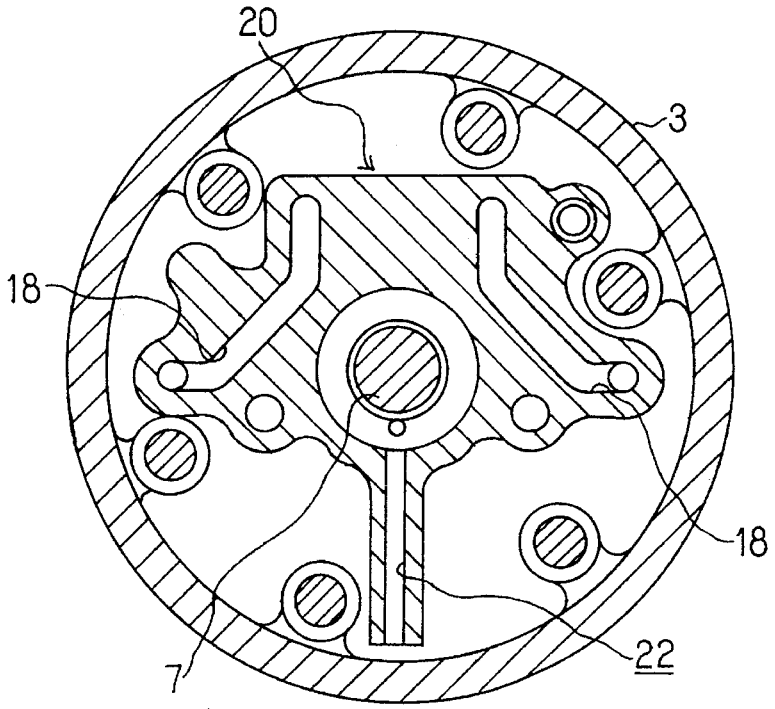
FIG. 5 is a transverse cross-sectional view taken along a rear side plate of another embodiment of a rotary vane-type refrigerant compressor.

A modified embodiment of the invention is shown in FIG. 5, which differs from the first embodiment in that the discharge passages 18 are formed narrower throughout their length for improvement of their effect of suppressing the pulsation. Though not shown in the drawing, alternatively, part of the discharge passage may be reduced in its width and/or depth. As a further embodiment, the discharge passage may be provided along its length with any suitable restrictions designed to diminish the pulsation.

Regarding the oil separator 19, its two oil separator shells 20 may be substituted with a single shell so that the two outlets 18*b* of the discharge passages 18 are opened to a single oil separating chamber. In so arranging, two flows of refrigerant gas from the discharge passages 18 collide and interfere with each other in the oil separating chamber and this interference can contribute to reducing the pulsation.

It will be obvious to those skilled in the art that other changes and modifications may be made in the invention, in the light of the foregoing teachings, without departing from the scope of the invention defined in the appended claims.

What is claimed is:

1. A rotary compressor of the vane-type adapted for use in an air conditioning system comprising:

housing means;

a cylinder block accommodated in said housing means;

a drive shaft rotatably supported in said housing means and extending through said cylinder block;

a rotor fixed on said drive shaft for rotation therewith and disposed in said cylinder block, said rotor having formed therein a plurality of substantially radially extending slots;

a pair of front and rear side plates disposed in said housing means so as to close the axial ends of said cylinder block;

a plurality of vanes slidably received in said slots and cooperating with said cylinder block, said rotor and said front and rear side plate to form a plurality of compression chambers;

a discharge chamber formed between said housing means and said cylinder block for receiving refrigerant gas compressed in said compression chambers and discharged therefrom;

an oil separator compartment formed by said housing means and said rear side plate, having therein an oil separator fixed to said rear side plate in contact therewith for separating from said refrigerant at least part of an lubricating oil contained in the refrigerant, and providing at the bottom thereof an oil reservoir;

discharge passage means providing communication between said discharge chamber and said oil separator compartment;

a delivery port formed through said housing means for allowing the refrigerant to flow out therethrough to be discharged from the compressor;

said discharge passage means including a restricted passage portion whose transverse cross sectional area is smaller than that of said delivery port, and part of said discharge passage means being disposed in the area of said contact between said rear side plate and said oil separator.

2. A rotary compressor of the vane-type according to claim 1, wherein said discharge passage means has at least one bent portion.

3. A rotary compressor of the vane-type according to claim 2, wherein said discharge passage means includes a first passage portion formed axially through said rear side plate and a second passage portion disposed in said area of contact between the rear side plate and the oil separator.

4. A rotary compressor of the vane-type according to claim 3, wherein said restricted passage portion is provided by said first passage portion.

5. A rotary compressor of the vane-type according to claim 3, wherein said restricted passage portion is provided by said second passage portion.

6. A rotary compressor of the vane-type according to claim 3, wherein said restricted passage portion is provided by said first and second passage portions.

7. A rotary compressor of the vane-type according to claim 3, wherein said second passage portion is provided by a groove formed in a lateral surface of said rear side plate remote from said discharge chamber.

8. A rotary compressor of the vane-type according to claim 3, wherein said second passage portion includes at least one bent portion.

9. A rotary compressor of the vane-type according to claim 1, wherein said oil separator is of a centrifugal type.

10. A rotary compressor of the vane-type according to claim 9, wherein said oil separator includes a shell portion defining therein a cylindrical oil separating chamber communicating with said discharge passage means, a tubular member fixed to said shell portion at the top thereof and extending downward in said oil separating chamber for allowing the refrigerant with part of the oil separated therefrom to flow through said shell portion into said oil separator compartment, an oil guide hole for allowing the oil separated from the refrigerant to pass therethrough toward said oil reservoir, said discharge passage means being opened to said oil separating chamber so as to produce a circling motion of the refrigerant in said oil separating chamber.

11. A rotary compressor of the vane-type adapted for use in an air conditioning system comprising:

housing means;

a cylinder block accommodated in said housing means;

a drive shaft rotatably supported in said housing means and extending through said cylinder block;

a rotor fixed on said drive shaft for rotation therewith and disposed in said cylinder block, said rotor having formed therein a plurality of substantially radially extending slots;

a pair of front and rear side plates disposed in said housing means so as to close the axial ends of said cylinder block;

a plurality of vanes slidably received in said slots and cooperating with said cylinder block, said rotor and said front and rear side plate to form a plurality of compression chambers;

a discharge chamber formed between said housing means and said cylinder block for receiving refrigerant gas compressed in said compression chambers and discharged therefrom;

an oil separator compartment formed by said housing means and said rear side plate, having therein an oil separator fixed to said rear side plate in contact therewith for separating from said refrigerant at least part of any lubricating oil contained in the refrigerant, and providing at the bottom thereof an oil reservoir;

discharge passage means providing communication between said discharge chamber and said oil separator compartment;

a delivery port formed through said housing means for allowing the refrigerant to flow out therethrough to be discharged from the compressor;

said discharge passage means having flow restriction and including a first passage portion formed axially through said rear side plate and a second passage portion disposed in said area of contact between the rear side plate and the oil separator and a restricted passage portion whose transverse cross sectional area is smaller than that of said delivery port.

12. A rotary compressor of the vane-type according to claim 11, wherein said flow restriction means is provided by said first passage portion.

13. A rotary compressor of the vane-type according to claim 11, wherein said flow restriction means is provided by said second passage portion.

14. A rotary compressor of the vane-type according to claim 11, wherein said flow restriction means is provided by said first and second passage portions.

15. A rotary compressor of the vane-type according to claim 11, wherein said second passage portion includes at least one bent portion.

* * * * *

UNITED STATES PATENT AND TRADEMARK OFFICE

CERTIFICATE OF CORRECTION

PATENT NO. : 5,499,515

DATED : March 19, 1996 Page 1 of 2

INVENTOR(S) : C. Kawamura et al

It is certified that error appears in the above-indentified patent and that said Letters Patent is hereby corrected as shown below:

Column 2, line 20, "plate" should read --plates--; line 67, after "of" insert --the--.

Column 3, line 1, delete "along a"; line 2 before "rotor" insert "through the"; same line after "compressor" insert --as seen from lines 2-2 in Fig. 1--; line 3, delete "along"; line 4, after "compressor" insert comma --,--; line 6, delete "along"; line 7, after "compressor" insert comma --,--; line 8, "3-3" should read --4-4--; line 9, after "view" insert --similar to Fig. 3, but--; same line, delete "along a"; line 10, before "rear" insert --through the--; line 53, "function" should read --functions--; line 54, delete "the" (second occurrence).

UNITED STATES PATENT AND TRADEMARK OFFICE

CERTIFICATE OF CORRECTION

PATENT NO. : 5,499,515

DATED : March 19, 1996

INVENTOR(S) : C. Kawamura et al

It is certified that error appears in the above-indentified patent and that said Letters Patent is hereby corrected as shown below:

Column 5, line 3, after "8" insert comma --,--; line 42, after "described" insert --in--; line 53, "length" should read --lengths--;

Column 6, line 18, after "rotor" insert comma --,--; line 19, "plate" should read --plates--; line 29, "an" should read --any--.

Column 7, line 31, after "rotor" insert comma --,--; line 32, "plate" should read --plates--.

Column 8, line 15, after "restriction" insert --means--.

Signed and Sealed this

Twenty-sixth Day of November 1996

*Attest:*

Bruce Lehman

BRUCE LEHMAN

*Attesting Officer*

*Commissioner of Patents and Trademarks*